US005080622A

United States Patent [19]

Tuin et al.

[11] Patent Number: 5,080,622

[45] Date of Patent: Jan. 14, 1992

[54] DISPLAY TUBE AND METHOD OF MANUFACTURING SUCH A DISPLAY TUBE

[75] Inventors: Hermanus N. Tuin; Piet C. J. Van Rens, both of Eindhoven, Netherlands

[73] Assignee: U. S. Philips Corporation, New York, N.Y.

[21] Appl. No.: 516,009

[22] Filed: Apr. 27, 1990

[30] Foreign Application Priority Data

May 2, 1989 [NL] Netherlands ..... 8901105

[51] Int. Cl.[5] ..... H01J 5/03

[52] U.S. Cl. ..... 445/8; 358/247

[58] Field of Search ..... 445/8; 358/247

[56] References Cited

U.S. PATENT DOCUMENTS 2,160,081 5/1939 Niclassen ..... 445/8 X 3,952,152 4/1976 Lill et al. ..... 445/8 X

*Primary Examiner*—Kenneth J. Ramsey

*Attorney, Agent, or Firm*—John C. Fox

[57] ABSTRACT

The invention relates to a method of manufacturing a display tube in which a transparent plate 9 is secured to the display window 2 by securing means 10 located between and exclusively along the edge portions of the display window 2 and the transparent plate 9. Subsequently, the envelope and the space 12 between the display window and the transparent plate 9 are evacuated substantially simultaneously. An optical coupling means is then provided in the space 12 between the display window 2 and the transparent plate 9.

2 Claims, 4 Drawing Sheets

DISPLAY TUBE AND METHOD OF MANUFACTURING SUCH A DISPLAY TUBE

BACKGROUND OF THE INVENTION

The invention relates to a method of manufacturing a display tube comprising an envelope having a display window, in which a transparent plate is secured on said display window during a process step, and the envelope is evacuated during another process step.

A method of the type mentioned in the opening paragraph is known from French Patent Specification 768,092. In the method described in said specification, the thickness of the display window is just enough to resist the difference in air pressure during the evacuation of the envelope. The display tube is protected against implosion (i.e., it is made resistant to vibrations and shocks) by bonding a glass plate to the display window by means of an adhesive layer, after the evacuation process.

In practice it has been found, however, that a colour display tube manufactured according to said known method may display images having insufficient colour purity.

OBJECTS AND SUMMARY OF THE INVENTION

One of the objects of the invention is to provide a method of manufacturing a display tube which is protected against implosion and which enables an image of sufficient colour purity to be displayed.

For this purpose, a method of manufacturing a display tube of the type mentioned in the opening paragraph is characterized according to the invention in that prior to the evacuation of the envelope, the transparent plate is mechanically secured to the display window by securing means arranged between and exclusively along edge portions of the display window and the transparent plate, after which the space between the display window and the transparent plate enclosed by the securing means is evacuated at least substantially simultaneously with the evacuation of the envelope.

The invention is based on the insight that the evacuation of the envelope brings about bending of the display window as a result of the difference in air pressure. As a result of this bending, a display screen of phosphor elements luminescing in different colours, which is provided on the inside of the display window, is subject to undesirable curvature which may lead to a locally insufficient colour purity of an image to be displayed. As, according to the invention, the space between the display window and the transparent plate is evacuated substantially simultaneously with the envelope, the display window is not loaded or deformed by a difference in air pressure. Consequently, the display window can be relatively thin. The transparent plate which is secured to the display window ensures that the display tube is resistant to the difference in air pressure inside the envelope and outside the display tube. In fact, it has been found that the mechanical stability of the relatively thin display window and the transparent plate secured thereto corresponds to the mechanical stability of a single alternative display window having a thickness which is equal to the sum of the thickness of the relatively thin display window and the transparent plate. The space between the display window and the transparent plate does not adversely affect said mechanical stability. In the manufacture of the display tube, all heating and cooling steps which are carried out before the transparent plate is secured to the display window can be carried out more quickly and cheaply by virtue of the relatively thin display window having a relatively small thermal capacity. This advantage does not only occur in the case of colour display tubes but also in the case of display tubes for displaying monochrome images. Consequently, the method according to the invention is also suitable for the manufacture of monochrome display tubes.

In order to preclude light reflections at the interface between the display window and the transparent plate, preferably an optical coupling means is arranged in the space between the display window and the transparent plate. An additional advantage is that the optical coupling means can be arranged after the envelope has been evacuated, so that it does not have to be capable of withstanding the effects of the temperature which is required for the evacuation process.

BRIEF DESCRIPTION OF THE DRAWINGS

A few embodiments of a method of manufacturing a display tube according to the invention will be explained with reference to the accompanying drawings, in which.

DESCRIPTION OF THE PREFERRED EMBODIMENTS

The display tubes can be used, for example, to display colour images or monochrome images such as, for example, TV pictures or letters, numerals, symbols or figures. By way of example, the invention is described in terms of a colour display tube.

Figure 1:
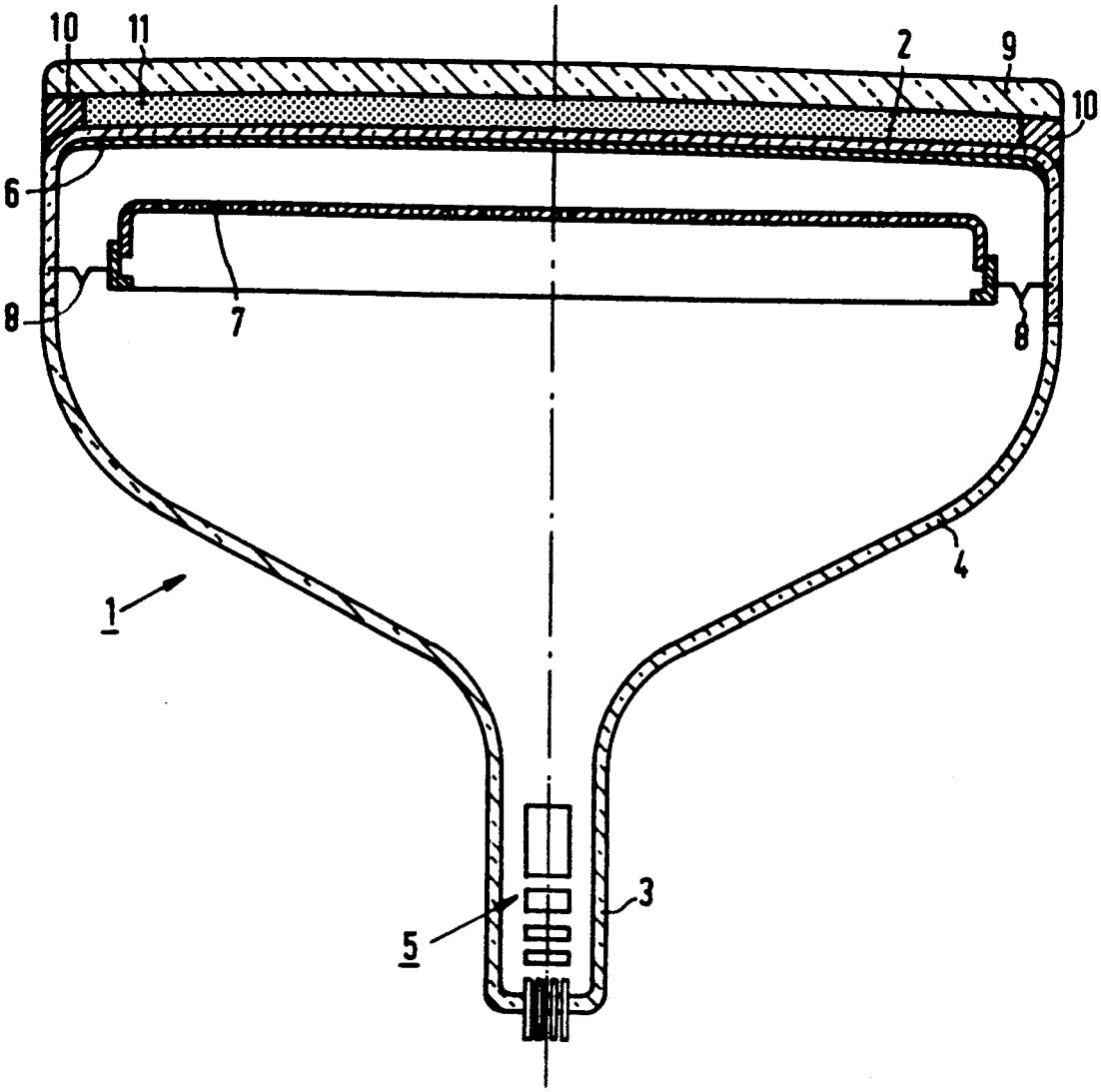
FIG. 1 is a diagrammatic sectional view of an embodiment of a display tube manufactured according to a method of the invention.

FIG. 1 is a diagrammatic sectional view of a colour display tube manufactured according to a method of the invention, said colour display tube comprising an envelope 1 having a substantially rectangular display window 2, a neck 3 and a conical enveloping part 4. An electrode system 5 for generating a number of electron beams is arranged in said neck 3. The display window 2 is provided on the inside with a display screen 6 comprising a large number of phosphor elements luminescing in red, green and blue. The phosphor elements may be in the form of, for example, dots or strips. On their way to the display screen 6, the electron beams are deflected across the display screen 6 by deflection means (not shown) and pass through a shadow mask 7 which consists of a thin metal plate having apertures. Said shadow mask 7 is suspended in the display window 2 by suspension means 8.

A transparent plate 9 which is made of, for example, glass is secured to the display window 2 by securing means 10 located between and exclusively along the edge portions of the display window 2 and the transparent plate 9. The distance between the display window and the transparent plate is, for example, approximately 0.5 mm. A glass frit or a curing synthetic resin may be used, amongst others, as the securing means 10. It is alternatively possible to use a thermo-compression bond to secure the transparent plate 9 to the display window 2. For this purpose, the securing means 10 comprise aluminum layers which are provided at the edge portions of the display window 2 and the transparent plate 9, and a metal element disposed between said aluminium layers.

Investigations have shown that a display tube according to the invention, in which the transparent plate 9 and the display window 2 are interconnected at their edge portions, has a mechanical strength which is comparable with that of a display tube comprising a display window having a thickness equal to the combined thickness of the transparent plate 9 and the display window 2. By virtue thereof, the display tube has an improved implosion resistance and can withstand drop testing, in particular, when the display tube has larger dimensions and/or the display window is flatter. Preferably, the display window 2 has a thickness which is smaller than that of the transparent plate 9, so that before the transparent plate is secured to the display window the manageability of the tube is improved.

In order to preclude light reflections at the interface between the display window 2 and the transparent plate 9 when the an image is displayed, an optical coupling means 11 is arranged between the display window 2 and the transparent plate 9. For example, lacquers based on acrylates, isocyanates, polycarbonates or polyethylene are used as an optical coupling means, although other coupling means known to those skilled in the art may alternatively be used.

Figure 2:
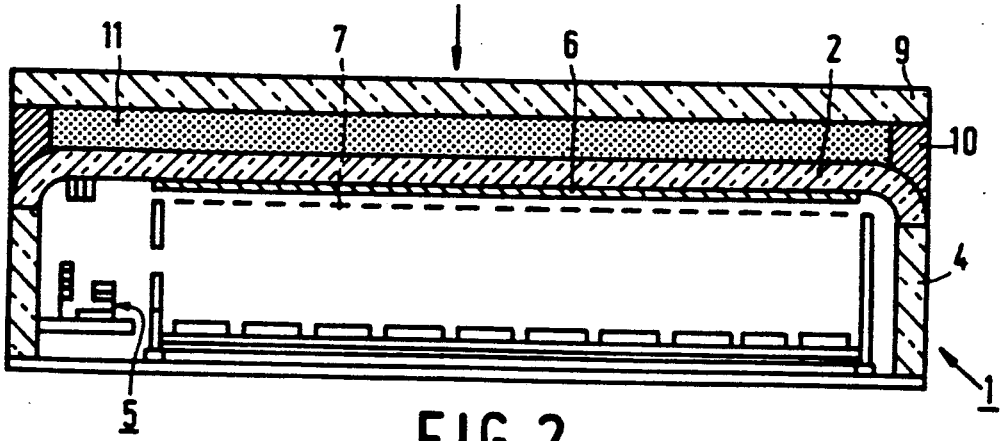
FIG. 2 is a diagrammatic sectional view of an alternative embodiment of a display tube manufactured according to a method of the invention.

FIG. 2 is a diagrammatic sectional view of an alternative embodiment of a colour display tube according to the invention. Said colour display tube comprises a flat display window 2 and a box-shaped enveloping part 4. The reference numerals denote the same parts as in FIG. 1.

Figure 3:
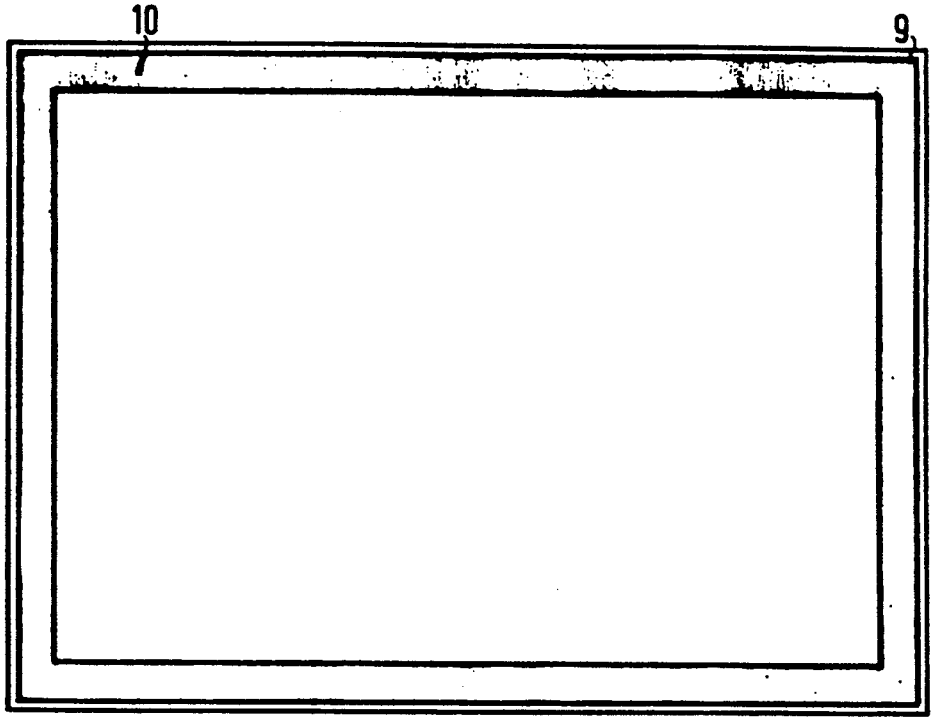
FIG. 3 is a diagrammatic elevational view of the display tube of FIG. 2 from the direction indicated by the arrow in FIG. 2, and FIGS. 4, 5 and 6 are diagrammatic sectional views which shows display tube at various stages of manufacturing a display tube according to the invention.

FIG. 3 is a diagrammatic elevational view of the colour display tube of FIG. 2, viewed in the direction of the arrow, and it clearly shows that the securing means 10 are arranged exclusively along the edge portion of the transparent plate 9. The display, which is completely or substantially surrounded by the securing means 10, can display an image via the display window, the optical coupling means and the transparent plate in a substantially unimpeded way.

Figure 4:
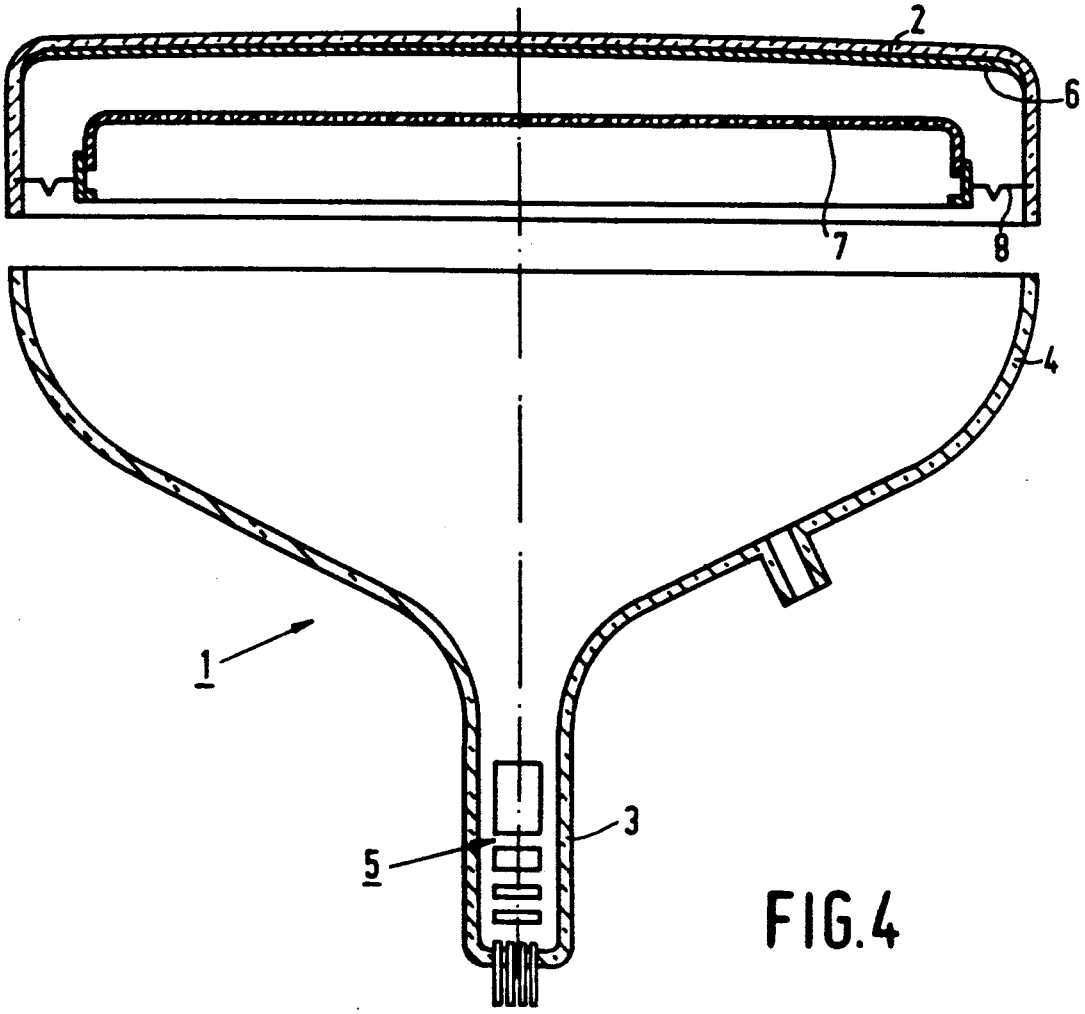
Figure 5:
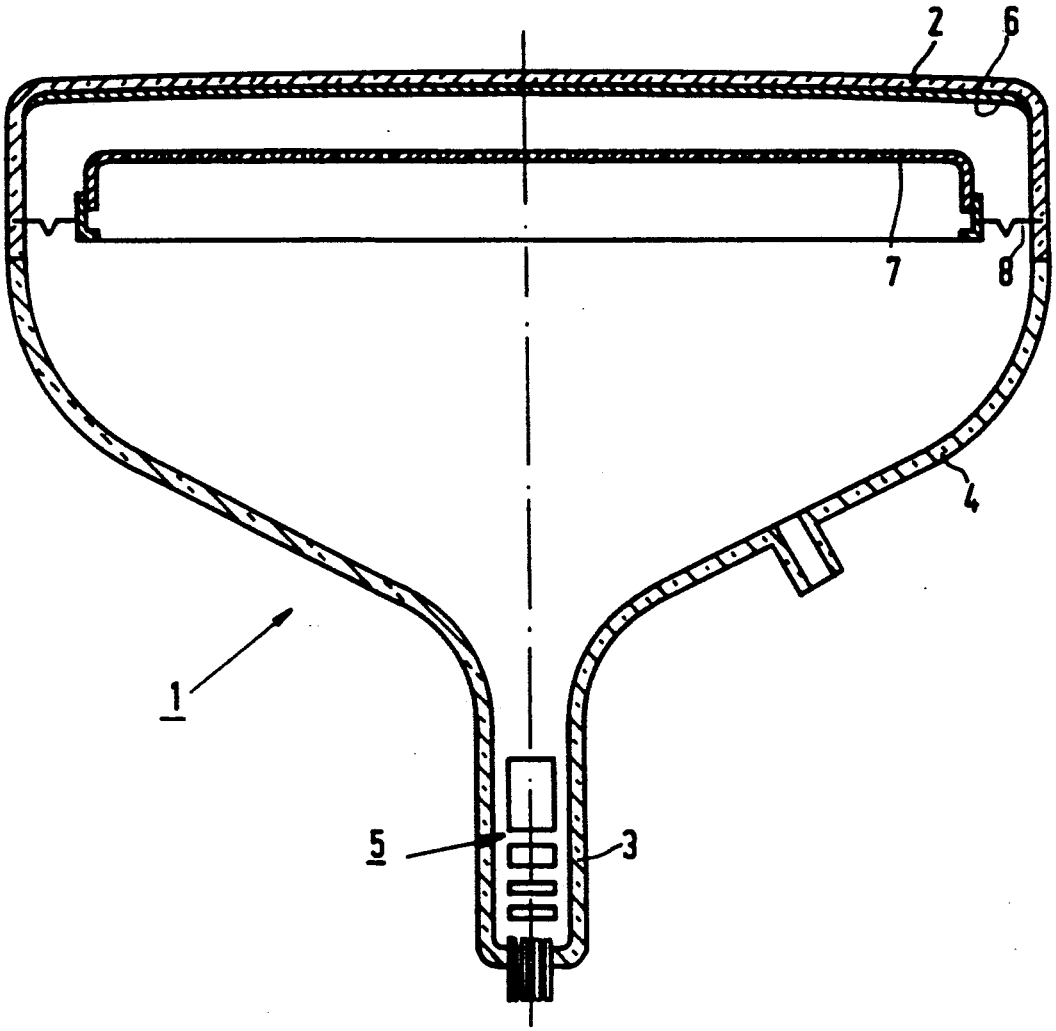
Figure 6:
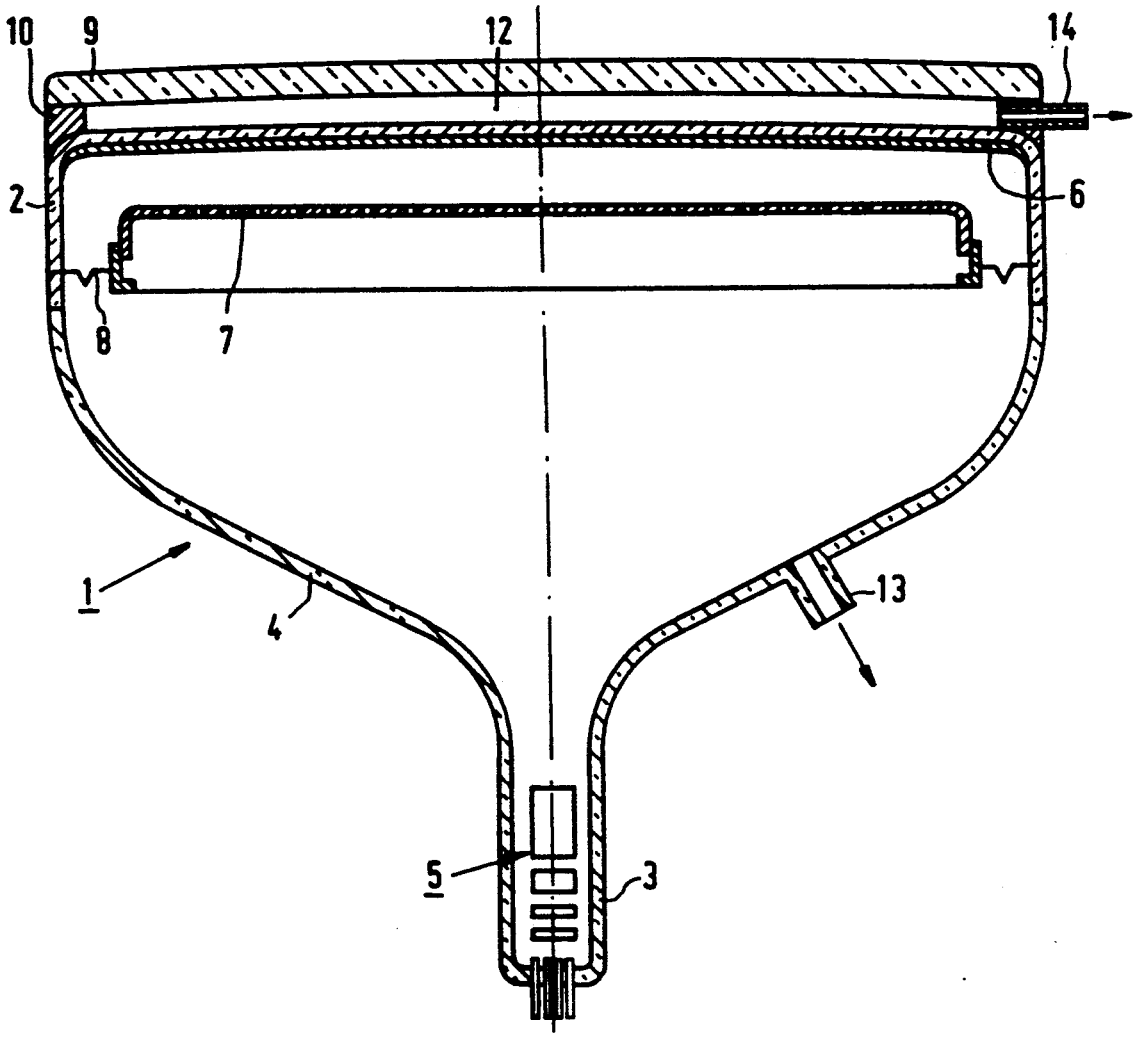

A method of manufacturing a display tube according to the invention will be described with reference to the FIGS. 4, 5 and 6. In one process step in the manufacture of a display tube, a display window 2, which may be of a relatively small thickness as described below, is provided with a display screen 6 by means of an exposure operation, and a shadow mask 7 is suspended in the display window 2 by means of suspension means 8. In another process step, an enveloping part 4 is provided with, inter alia, an electrode system 5. Subsequently, the finished enveloping part 4 and the finished display window 2 are aligned relative to one another (FIG. 4), after which they are interconnected in a heating step, so that an envelope 1 is formed (FIG. 5). By virtue of the small thickness of the display window 2, the envelope 1 is not heavy and can be handled easily. Furthermore, as the display window 2 has a small thermal capacity due to its small thickness, the heating and cooling processes occupy relatively little time and, hence, are advantageous from an economical point of view. Subsequently, a transparent plate 9 is bonded to the display window 2 by means of securing means 10, for example a glass frit. These securing means 10 are located between and exclusively along the edge portions of the display window 2 and the transparent plate 9, and enclose a space 12 (FIG. 6).

In a further process step, the envelope 1 is heated to approximately 450° C. and evacuated by means of an exhaust tube 13. The space 12 is evacuated substantially simultaneously via an exhaust tube 14. As a consequence thereof, there is no or only a small difference in air pressure on the display window 2, and, hence, the display window 2 is not loaded to any significant extent. As a result, the thickness of the display window 2 can be relatively small. It has been found that the connection formed along the edge portions of and between the display window 2 and the transparent plate 9 provides sufficient mechanical stability for the display tube to be resistant to the difference in pressure inside the envelope and outside the display tube after the evacuation process.

By virtue of the method according to the invention, the display window 2 can be of a relatively small thickness and, in addition, the display screen 6 is not deformed following evacuation. As a result, the position of the display screen 6 in the finished condition of the display tube is the same as its position immediately after the above exposure process. This is in contrast with the known manufacturing process in which the display window sags slightly after the evacuation of the envelope. This yields an improved operation of the display tube according to the invention, in particular, as regards colour purity.

Following the evacuation, an optical securing means is provided in the space 12. During said operation the display tube has cooled, so that an optical coupling means can be used which does not have to be compatible with the evacuation temperature but which only has to be optimally suitable for optically interconnecting the transparent plate and the display window. The optical coupling means can be introduced into the space 12 in the manner described hereinbelow. Following the evacuation of the envelope 1 via the exhaust tube 13, said exhaust tube 13 is closed. After the envelope 1 has cooled, the optica coupling means is drawn into the space 12 via the exhaust tube 14 by means of an inlet valve (not shown in FIG. 6) which projects from the securing means 10. When the space 12 is completely filled with the optical coupling means, the inlet valve and the exhaust tube 14 are closed and the display tube is completed.

We claim:

1. A method of manufacturing a display tube comprising an envelope having a display window, the method comprising securing a transparent plate on the display window and evacuating the envelope, characterized by, before evacuating the envelope, securing the transparent plate to the display window exclusively along edge portions of the display window and the transparent plate, and then evacuating the space between the display window and the transparent plate enclosed by the securing means substantially simultaneously with the envelope, such that the display window is not loaded to any significant extent.

2. A method as claimed in claim 1, characterized by arranging an optical coupling means in the space between the display window and the transparent plate.

* * * * *